United States Patent [19]

Davies

[11] Patent Number: 4,977,490

[45] Date of Patent: Dec. 11, 1990

[54] FLUORESCENT LIGHT FITTING AND SYSTEM

[75] Inventor: John H. Davies, Rotherham, England

[73] Assignee: Fifth Generation Technology (Manufacturing) Ltd., Rotherham, England

[21] Appl. No.: 315,598

[22] Filed: Feb. 27, 1989

[30] Foreign Application Priority Data

Feb. 27, 1988 [GB] United Kingdom ..... 8804636

[51] Int. Cl.[5] ..... F21S 3/00; F21V 21/00

[52] U.S. Cl. ..... 362/221; 362/225; 362/260; 362/249

[58] Field of Search ..... 326/219, 225, 260, 221, 326/240, 241, 249; 362/147

[56] References Cited

U.S. PATENT DOCUMENTS

| | | | |
|---|---|---|---|
| 2,597,739 | 5/1952 | Lacy et al. | 362/219 |
| 2,702,378 | 2/1952 | Talty | 339/147 |
| 2,724,047 | 11/1955 | Zurawski | 362/260 X |
| 2,849,595 | 8/1958 | Zurawski | 362/219 |
| 2,951,148 | 8/1960 | Stahlhut | 362/219 |
| 3,075,072 | 1/1963 | Gibson et al. | 362/219 |
| 3,293,426 | 12/1966 | Zeitz et al. | 362/221 |
| 3,375,322 | 3/1968 | Serio et al. | 362/219 X |
| 3,436,537 | 4/1969 | Bostonian | 362/219 |
| 3,594,568 | 7/1971 | Guth, Jr. | 240/51 |
| 3,697,743 | 10/1972 | Eargle | 362/260 |
| 4,327,403 | 4/1982 | Capostagno et al. | 362/147 X |
| 4,336,575 | 4/1982 | Gilman | 362/147 |
| 4,674,015 | 6/1987 | Smith | 362/260 X |
| 4,726,781 | 2/1988 | Bernhart et al. | 362/219 X |

FOREIGN PATENT DOCUMENTS

| | | | |
|---|---|---|---|
| 1193604 | 5/1965 | Fed. Rep. of Germany . | |
| 2119196 | 4/1971 | Fed. Rep. of Germany . | |
| 2052192 | 3/1971 | France . | |
| 2394747 | 2/1979 | France | 362/221 |
| 576852 | 4/1946 | United Kingdom . | |

*Primary Examiner*—Stephen F. Husar
*Assistant Examiner*—Peggy A. Neils
*Attorney, Agent, or Firm*—R. A. Giangiori

[57] ABSTRACT

A fluorescent light fitting (1) comprises an elongate metal casing (2) of hollow cross-section with spaced-apart fluorescent tube holders (6) projecting from at least one wall (5) of the casing (2) and with another wall (4) of the casing provided with a removable or releasable baseplate (14) on which internal electrical components (13) are mounted, with means (18, 19, 20) to fasten the baseplate (14) to the fitting (1).

12 Claims, 3 Drawing Sheets

FLUORESCENT LIGHT FITTING AND SYSTEM

This invention relates to a fluorescent light fitting and system particularly though not exclusively for workplace, factory or office use.

The economic benefits derived from the use of fluorescent tubes are well known but conventional elongate metallic casings, suspended from or screwed to ceilings or walls, present an access problem for service or repair in that before the internal electrical components, e.g. a choke condenser, starter etc., i.e. the so-called running gear, can be reached it is necessary to remove the fluorescent tube, its reflector and a cover plate before access is possible to the internal components. Furthermore, the cover plate, relector and tube must all be replaced before the repaired or serviced components can be tested. This is a tedious and normally two-man operation as the fittings are usually at inconvenient locations, e.g. overhead.

According to a first aspect of the present invention, there is provided a fluorescent light fitting comprising an elongate metal casing of hollow cross-section with spaced-apart fluorescent tube holders projecting from at least one wall of the casing and with another wall of the casing provided with a removable or releasable baseplate on which internal electrical components are mounted, with means to fasten the baseplate to its wall.

Thus, with the fitting construction in accordance with the invention, servicing and/or repair of the internal electrical components can be effected without the need to remove and subsequently replace, the reflector and fluorescent tube.

Furthermore, the fastening means is preferably of a single screw or a quick-release type, e.g. a winged stud rotatable through 90° between fastening and non-fastening positions to engage a suitable aperture e.g. of a slotted hole. In detail, such aperture may be at one end or side of the baseplate, with the stud captivated to the fitting, while the other end or side of the baseplate may be provided with a projecting tongue to engage over an inner portion of the casing. By such an arrangement removal of the baseplate can be a one-handed and hence one man operation. In an alternative construction, the other end or side of the baseplate may be hinged to the casing, to provide a drop-down releasable baseplate, in contrast to a totally removable baseplate.

Although the electrical components may be carried directly by the removable baseplate, it is preferred that they are carried indirectly by being mounted on an exchangeable support or gear tray, in turn mounted on the removable baseplate. It follows that the removable gear tray is releasably attached to the baseplate, and again a quick-release release fastening means is preferred, such as 90° rotatable winged studs or screw and bush on stud and nut and suitably slotted apertures, again to provide for one man operation. Consequently, a failed or faulty fitting can be rapidly restored to service by a gear tray exchange, with suitable wiring disconnections and re-connections, which are preferably hard wiring connections, and with the faulty gear tray examined and repaired either on site or at a later date in a workshop with full test facilities.

In detail, the fitting comprises an upper wall, e.g. adapted to be secured to a ceiling, roof, walls, standard trunking etc., by standard fixing methods, and a lower, parallel wall spaced from the upper wall by a pair of side walls, with holders for fluorescent tubes carried by each sidewall, with one, but preferably both sidewall carrying a single tube or multiple tubes. Preferably, the casing is formed as an integral pressing from sheet metal. The sidewalls are preferably angled downwardly to define an acute angle. Each casing is preferably of a unit length convenient for handling/transport/storage, e.g. of 1, 2 or more meters length. Each casing may terminate in an end wall, by the use of which adjacent ends of adjacent casings may be butted and secured together, e.g. by the use of screws. In an alternative construction, a spigot and socket type connection may be used between adjacent ends of adjacent casings, either by slightly enlarging one end of each casing, or by the use of a coupling sleeve common to both casing ends, and clearly some fastening means, e.g. a screw, is required.

It is also conventional practice to provide a batten and trunking to convey power to fluorescent fittings, this being a more or less permanent fixture and, if located wrongly, or if a change in light fitting position is required, needs to be dismantled and re-located.

According to a second aspect of the present invention, of independent significance, there is provided a fluorescent light fitting comprising an elongate metal casing of hollow section housing at least one electrical power supply conductor or bus-bar extending the full length, or substantially the full length, of the casing, whereby a plurality of casings may be located together end-to-end, with the power supply conductor(s) or bus-bar(s) of ad]a cent casings electrically connected together.

According to a third aspect of the present invention, of independent significance, there is provided a lighting system comprising a plurality of elongate metal casings in accordance with the second aspect of the invention secured together end-to-end, and adapted to be supported from, or secured to, a ceiling/roof, or secured to a wall.

The fitting and system in accordance with the second and third aspect of the invention advantageously provides a fitting/system with self-contained or integrated power supply trunking/cabling/bus-bars.

The casing is preferably of elongate hollow section, with a plurality of such casings adapted to be located end-to-end, along a production line for example. Preferably, the or each casing is provided with end walls having apertures, e.g. three, for entry and exit of conductors/cables at each end of the casing. For this end-to-end connection, the apertures are preferably provided with industry standard cable glands, with the conductors/cables .looped through the casings during installation. If a flexible or semi-flexible conductor, e.g. insulated cables, is or are employed, then preferably these conductors/cables are positionally controlled by a cable retaining hoop, or series of hoops along the casing, to obviate the conductors/cable(s) sagging or coming into close proximity, or contact, with the running gear. Such a hoop or hoop system is of course unnecessary if the conductor(s) is in the form of a rigid bus-bar. In addition, the interior of the casing m ay be so dimensioned as to be capable of accommodating and routing non-related services.

It will be appreciated that if the first aspect of the invention is incorporated into the second or third aspects of the invention, then the removable or releasable cover plate also provides ready access to the conductors/cables or bus-bars for connection, servicing or repair thereof.

Examples of the fitting in accordance with the first aspect of the invention, and the fittings and system in accordance with the third aspect of the invention, are shown in the accompanying drawings, in which.

Figure 2:
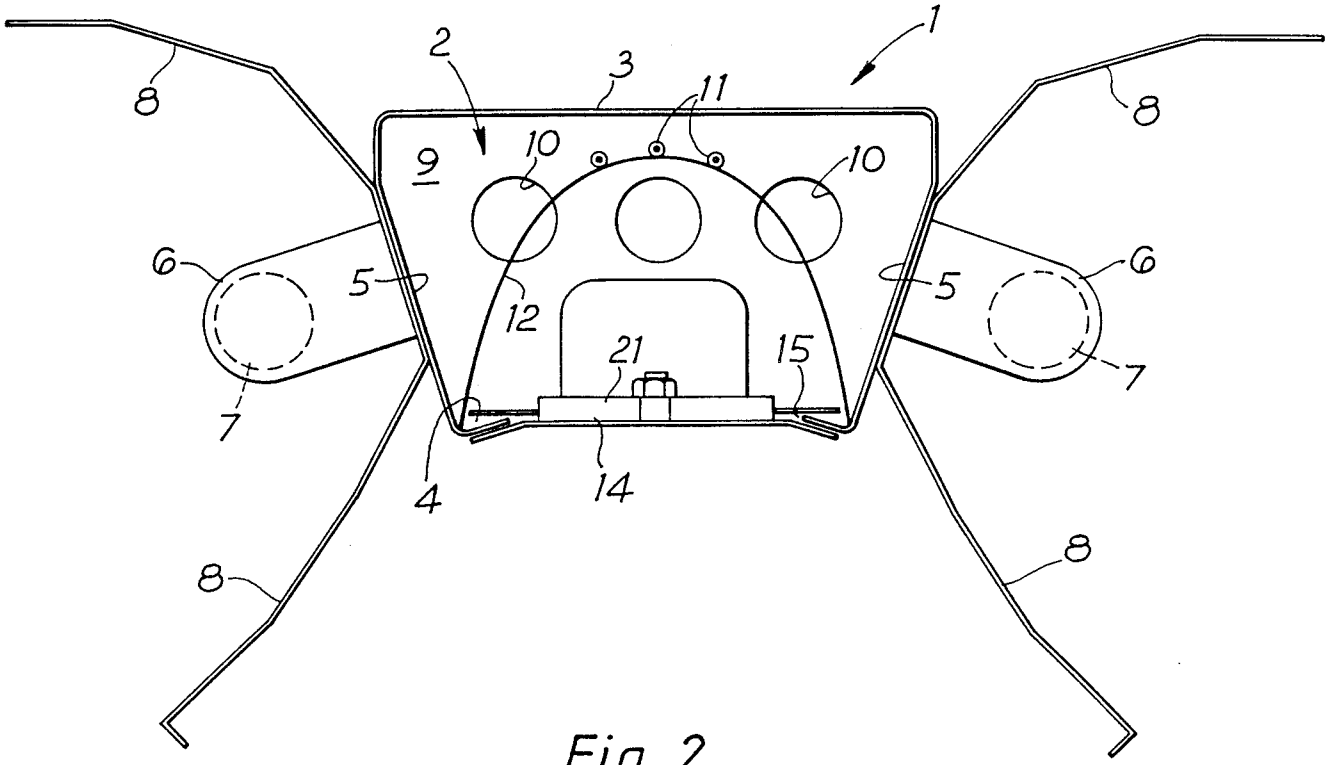
FIG. 2 is a diagrammatic end elevation of the fitting of FIG. 1 to a larger scale.

In the drawings, a fluorescent light fitting 1 comprises an elongate hollow metal casing 2 of unit length, pressed from sheet metal. The casing 2 comprises an upper wall 3 adapted to be secured to, or suspended from, a ceiling, or to be secured to a wall or other support structure, and having a lower, parallel wall 4 spaced from the upper wall 3 by a pair of sidewalls 5 which are angled downwardly as indicated in FIG. 2, with each sidewall 5 carrying a pair of spaced apart holders 6 to receive opposite ends of a fluorescent tube 7, with a reflector 8 extending the length of the casing-/tube and also secured to each sidewall 5. Also as best indicated in FIG. 2, each casing 2 terminates in an endwall 9 having three apertures 10 for entry of insulated conductor cables 11 at one end of the casing, and exit of cables from the other end of the casing, with the cables looped through the casing and positionally controlled by a series of hoops 12 along the casing.

Figure 1:
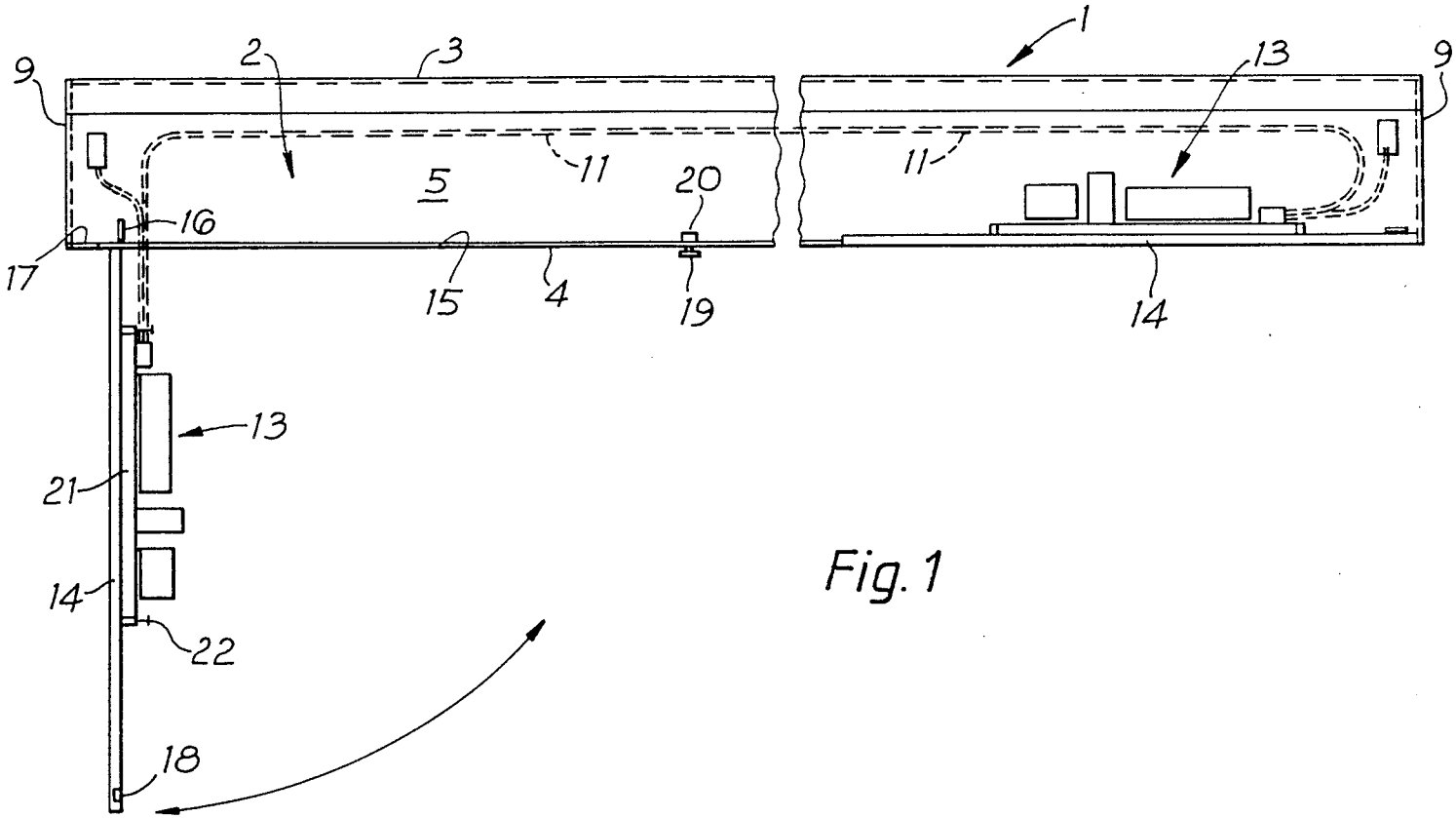
FIG. 1 is a diagrammatic side elevation of a fitting in accordance with the first aspect of the invention.

The tubes 7 are powered v ia industry-standard components 13, known as "running gear" located internally of the casing, and in accordance with the first aspect of the invention, the components 13 are mounted on a readily removable or releasable base plate 14 shown at the right hand side of FIG. 1 in its closed, active position, and at the left hand side of FIG. 1 in its released, open position for servicing, repair, etc., the components 13 of one base plate being for powering the tube(s) 7 of one sidewall 5, and the components 13 of the other base plate being for powering the tube(s) 7 of the other sidewall 5. Each baseplate 14 is oblong and serves, in its closed position, to close off a correspondingly oblong slot 15 provided in the lower wall 4, towards each opposite end of the casing, and each baseplate 14 is provided at one end with a tongue 16 to seat on inner portion 17 of the lower wall 4, and at its other end with a pair of laterally spaced-apart slotted apertures 18, each to receive a wing 19 of a stud 20 captivated to the lower wall 4 of the casing and rotatable through 90° between fastening and non-fastening positions.

In detail, the components 13 are mounted indirectly on the baseplate 14, via a tray 21 which is readily removable and replaceable by means of a similar quick-release fastening means in the form of winged studs 22 rotatable through 90° between fastening and non-fastening positions captivated either to the tray or to the baseplate and adapted to penetrate slotted apertures in the other.

Figure 3:
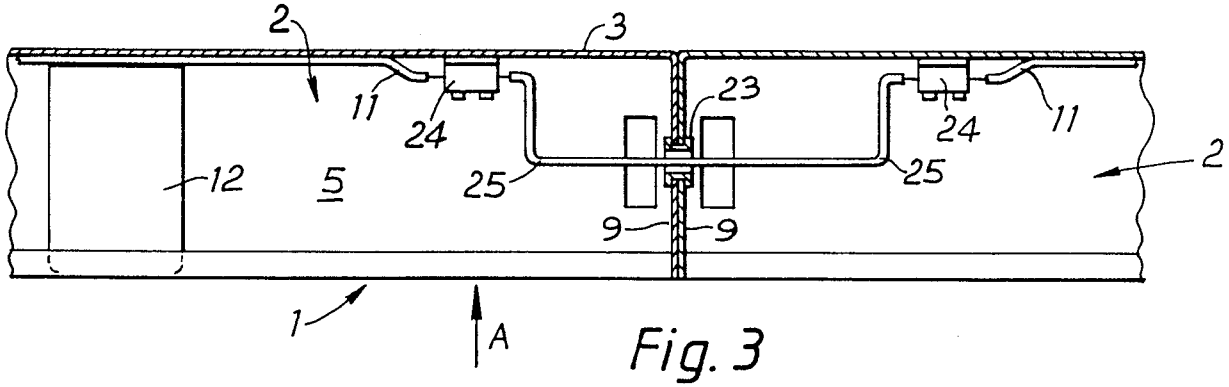
FIG. 3 shows diagrammatically a lighting system in accordance with the second and third aspects of the invention, with one casing sidewall removed for clarity.
Figure 4:
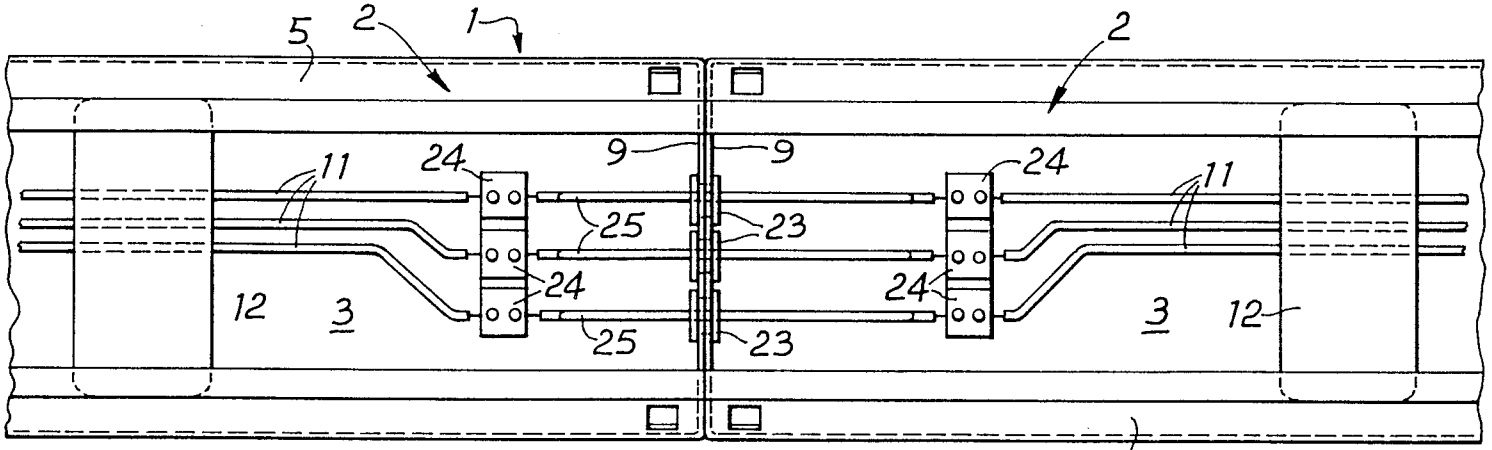
FIG. 4 is an underneath plan view in the direction of arrow A of FIG. 3.

The second and third aspects of the invention are illustrated in FIGS. 3 and 4. Endwalls 9 of adjacent casings 2 are butted together and secured by metallic glands 23 e.g. of brass, which are screwed together, whereby, in contrast to prior art proposals, each casing 2 provides a self-contained conduit for cables 11, busbars or trunking, with attendant advantages discussed earlier. Also, as detailed in FIGS. 3 and 4, the three insulated cables 11 (being live, neutral and earth) are each connected to a terminal block 24 secured, e.g. by adhesive, to the inside of the upper wall 2, and to each terminal block 24 is also secured one of three fly wires 25 bridging the butted walls 9 and extending to three similar terminal blocks 24 in the adjacent casing 2. Clearly, additional terminal blocks 24 may be provided for additional sets of cables 11.

What I claim is:

1. A fluorescent light fitting comprising an elongate metal casing of hollow cross-section comprising an upper wall, a pair of spaced-apart sidewalls spacing said upper wall from a lower wall parallel to said upper wall, spaced-apart fluorescent tube holders projecting from an external surface of each of said sidewalls, said sidewalls being angled downwardly to define an acute angle, a movable baseplate provided on said lower wall, electrical control components mounted on said baseplate, and fastening means to fasten and release said baseplate to its wall, with said components normally located internally of said casing when said baseplate is in its fastened position, and with said components temporarily exposed for servicing when said baseplate is released, and with said electrical components carried indirectly by said baseplate, being mounted on an exchangeable gear tray, in turn releasably attached to said baseplate.

2. A fluorescent light fitting as claimed in claim 1, wherein said fastening means is of a quick release type.

3. A fluorescent light fitting as claimed in claim 1, wherein said fastening means is a winged stud rotatable through 90° between fastening and non-fastening positions.

4. A fluorescent light fitting as claimed in claim 3, wherein said fastening means is captivated to said fitting, and an aperture is provided in said baseplate, and said fastening means is engageable with said aperture.

5. A fluorescent light fitting as claimed in claim 4, wherein one end of said baseplate is provided with said aperture and a projecting tongue is provided at the other end of said baseplate, with an inner portion of said casing being provided with means engageable by said projecting tongue.

6. A fluorescent light fitting as claimed in claim 1, wherein said baseplate is hinged to said casing, to provide a drop-down releasable baseplate when said fastening means is released.

7. A fluorescent light fitting as claimed in claim 1, wherein said baseplate is removable from said fitting when said fastening 8. A fluorescent light fitting as claimed in claim 1, wherein said a quick-release fastening means serves to attach releasably said gear tray to said baseplate.

9. A fitting as claimed in claim 8, wherein said fastening means comprises 90° rotatable winged studs.

10. A fluorescent light fitting as claimed in claim 1, wherein said casing is formed as an integral pressing from sheet metal.

11. A fluorescent light fitting as claimed in claim 1, wherein said casing is of unit length.

12. A fluorescent light fitting as claimed in claim 11, wherein said casing terminates in an end wall, by the use of which end wall adjacent ends of adjacent casings are butted and secured together.

* * * * *